US007008141B2

(12) United States Patent
Fitzgerald et al.

(10) Patent No.: US 7,008,141 B2
(45) Date of Patent: Mar. 7, 2006

(54) COLLAPSIBLE BUOYANCY DEVICE FOR RISERS ON OFFSHORE STRUCTURES

(75) Inventors: John A. Fitzgerald, New Orleans, LA (US); Marcus A. Smedley, Mesquite, TX (US); Harold B. Skeels, Kingwood, TX (US); Christopher E. Cunninham, Spring, TX (US)

(73) Assignee: FMC Technologies, Inc., Chicago, IL (US)

( * ) Notice: Subject to any disclaimer, the term of this patent is extended or adjusted under 35 U.S.C. 154(b) by 97 days.

(21) Appl. No.: 09/730,414

(22) Filed: Dec. 4, 2000

(65) Prior Publication Data

US 2003/0180097 A1 Sep. 25, 2003

Related U.S. Application Data

(60) Provisional application No. 60/169,438, filed on Dec. 7, 1999.

(51) Int. Cl.
*E21B 7/12* (2006.01)

(52) U.S. Cl. ..... 405/224.2; 405/223.1; 166/350

(58) Field of Classification Search ..... 405/224.2, 405/224, 216, 195.1, 171; 166/350, 367, 166/345

See application file for complete search history.

(56) References Cited

U.S. PATENT DOCUMENTS 3,855,656 A 12/1974 Blenkarn
3,858,401 A 1/1975 Watkins
4,099,560 A * 7/1978 Fischer et al. ..... 166/350
4,176,986 A * 12/1979 Taft et al. ..... 405/224.2
4,234,047 A 11/1980 Mott
4,422,801 A * 12/1983 Hale et al. ..... 405/224.2
4,545,437 A * 10/1985 Denison ..... 166/345
4,557,332 A * 12/1985 Denison et al. ..... 166/345
4,566,824 A * 1/1986 Minier et al. ..... 405/202
4,616,707 A * 10/1986 Langner ..... 166/345
4,617,998 A * 10/1986 Langner ..... 166/345
4,634,314 A 1/1987 Pierce
4,821,804 A * 4/1989 Pierce ..... 405/224.2
5,046,896 A 9/1991 Cole
6,004,074 A 12/1999 Shanks
6,155,748 A 12/2000 Allen et al.
6,257,337 B1 * 7/2001 Wells ..... 166/350
6,457,527 B1 * 10/2002 Wells ..... 166/350

* cited by examiner

*Primary Examiner*—Frederick L. Lagman
(74) *Attorney, Agent, or Firm*—Gary L. Bush; Andrews Kurth LLP

(57) ABSTRACT

Expandable and contractible buoyancy modules are assembled to the risers of a deepwater exploration spar or other offshore structure to provide an upwardly directed buoyancy force to offset at least a portion of the weight of the riser. The buoyancy modules have a fabricated pressure tight expandable and contractible envelope composed of rubber or rubber-like material which is mounted onto a tubular member having a central passage for receiving the riser to be supported. The tubular member projects beyond the respective upper and lower ends of the envelope and defines upper and lower riser joint connectors and buoyancy module travel stops which secure the buoyancy module to the riser and provide for force transmission from the buoyancy module to selected locations along the length of the riser or to the upper end of the riser. The envelope is provided with at least one access port through which an inflation medium such as a gas or an uncured polymer can be added to control inflation of the envelope and through with liquid ballast is added or removed for ballast control.

23 Claims, 4 Drawing Sheets

116
114
112
118
120
108
80
140
110
108
106
106
102
98
100
104
96
88
90
86
92
94
84
82

COLLAPSIBLE BUOYANCY DEVICE FOR RISERS ON OFFSHORE STRUCTURES

This application claims priority benefit of U.S. Provisional application Ser. No. 60,169,438 filed Dec. 7, 1999.

BACKGROUND OF THE INVENTION

1. Field of the Invention

The present invention relates generally to the support of marine risers, such as offshore well production risers of deepwater spar type drilling and production platforms, which risers extend upwardly from the seabed to a drilling or production deck or working floor. More particularly, the present invention is directed to a system for combining the, upward forces of buoyant members to the riser or risers of deepwater spars and other marine platforms to thus assist in supporting the weight of the risers. The present invention also concerns selective installation of inflatable buoyant members to the risers during or after riser tieback to provide buoyant riser weight offsetting force along the length of the riser or at or near the upper stem joint of the riser. This invention further concerns the use of buoyancy modules which collapse to a small dimension for installation or retrieval through rotary drilling table openings or small openings in the deck structure of the spar and can be inflated with a gas or an uncured liquid foam composition and/or provided with liquid ballast individually, sequentially or simultaneously as desired.

2. Description of the Prior Art

On deepwater spars, metal buoyancy tanks, also referred to as "cans", are used to support the weight of production risers within the spar. Currently these buoyancy tanks are installed by two methods. In some cases buoyancy tanks are pre-installed into the spar structure prior to its launching. Alternatively, the buoyancy tanks may be installed after the spar is launched, by using one or more heavy lift vessels or derrick barges. The requirement for buoyancy installation at remote marine sites and the use of heavy lift vessels or derrick barges for buoyancy installation obviously adds significantly to the cost and complexity of buoyancy tank installations. The large dimensions and heavy handling weight of typical buoyancy cans, and the minimal size of most spar deck openings makes it ordinarily impossible to attach buoyancy cans to the riser structure at the level of the deck and then lower the buoyancy cans to the desired water depth thereof along with the riser during its installation and tieback. Thus, specialized and expensive buoyancy can installation equipment, typically in the form of an installation barge, is ordinarily required. The buoyancy tanks or cans are typically connected to various joints of the riser assembly so that buoyancy force is applied to the riser at selected locations along its length.

SUMMARY OF THE INVENTION

It is desirable to minimize the cost and installation time for riser support buoyancy. It is also desirable to provide an alternative method for installation of riser support buoyancy on marine risers on deepwater development structures, such as a well production or drilling spar. Further, it is desirable to provide for minimum buoyancy structure diameter during installation or for retrieval as compared to the installed diameter thereof, to thus promote ease and efficiency of installation and retrieval and to promote the capability for installation of buoyancy modules through small deck openings of a deepwater spar. It is also desirable to provide for application of buoyancy forces to selected sections of a riser assembly or to apply the buoyancy force of one or more buoyancy devices to the uppermost part of a riser assembly as desired.

Briefly, the various features of the present invention are realized by buoyancy modules having a fabricated pressure tight expandable and contractible envelope composed of rubber or rubber-like material. The envelope is preferably of generally cylindrical configuration and is mounted onto a tubular member having a central passage for receiving the riser to be supported. The tubular member projects beyond the respective upper and lower ends of the envelope and defines upper and lower riser joint connectors and buoyancy module travel slops. The envelope is provided with at least one access port through which air or other gases is added or removed to control inflation and contraction of the envelope and to control the counteracting upward buoyancy force for riser weight support. Water or other liquid ballast may be added to or removed from the envelope via the access port or through separate ballast port. In the event it is not considered desirable or necessary to also provide the capability for deflation of the buoyancy modules after installing them in assembly with a riser, the buoyancy modules may be inflated with an uncured polymer foam material which is injected into the collapsible pressure containing envelope in its uncured, essentially liquid state, at any selected point during the module installation procedure. The polymer foam material will expand or inflate the envelope and will then cure within the envelope, thus resulting in a permanently expanded or inflated envelope defining the buoyant component of the buoyancy module. It is envisioned that one or a plurality of buoyancy modules will be assembled at selected locations along the length of the riser assembly and that suitable inflation means will be used to inflate, deflate the envelopes or add or remove ballast liquid from the modules independently, simultaneously or selectively for desired buoyancy force application to the riser. Alternatively, the various buoyancy modules may be interconnected with one another and connected in force transmitting relation only to the uppermost or stem section of the riser assembly. In this case, the provision of a riser load measurement system at the region of buoyancy force transmission to the riser assembly will enable buoyancy to be controlled during installation and modified after installation according to the needs of the well production system.

During or after riser tieback, the buoyancy modules, in their collapsed or contracted condition, will be of sufficiently small diameter to be passed through a small spar deck opening, such as a rotary table opening. During riser tieback the buoyancy modules will be assembled to the riser at working deck level or at a level above the water-line of the spar. Because of their small diameter deflated or contracted condition, the buoyancy modules can be passed through a rotary table opening, spar deck opening or any other opening along with the riser sections being installed. Especially where more than one buoyancy module is to be assembled to a riser, the buoyancy modules can be provided with inflation and ballast manifolds or control lines which enable inflation, deflation or ballast control thereof to be achieved from the working deck of the spar. Because the buoyancy modules are expandable and collapsible, the buoyancy force thereof is adjustable so that riser weight support can be adjusted at any time. Obviously, where the buoyancy modules are filled with polymer form during the installation procedure, they will not thereafter be collapsible, though they may be removed from the riser assembly when desired.

After riser tieback, buoyancy modules of sectional construction may be lowered in the deflated condition thereof to desired riser depth and then assembled to the riser. For example, with a buoyancy module loosely assembled to a riser, the buoyancy module may be lowered to desired depth, using the riser as a positioning and travel guide. When desired depth and proper positioning of the buoyancy module has been achieved, the buoyancy module may then be secured to the riser. Inflation and ballasting of the buoyancy module may be subsequently accomplished when riser support is desired. When sectional buoyancy modules are utilized, the expandable and contractible envelopes thereof may be defined by two or more envelope sections each having an independent buoyancy chamber and each capable of being independently filled with air, another gas or uncured polymer foam for inflation and to receive water or another liquid for ballast control.

The buoyancy modules may be arranged to apply buoyancy force to selected sections of the riser assembly, if desired, or may be arranged to collectively apply an upwardly directed riser weight offsetting force only to the upper portion or upper stem joint of the riser assembly. In such case, a load measurement system may be interconnected with the buoyancy force application system and with the upper stem section of the riser assembly so that riser supporting buoyancy force is capable of efficient measurement and efficient control and is also capable of being changed as desired.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a simplified sectional view of a deepwater exploration or production spar shown in relation to the water-line and sea bottom of an ocean or other body of water and further showing a riser extending from the sea-bottom to the spar and having assembled thereto a plurality of riser support buoyancy modules embodying the principles of the present invention;

FIG. 2 is an isometric illustration of one of the buoyancy modules of FIG. 1, showing the basic construction thereof;

FIG. 3 is a sectional view of the buoyancy module of FIGS. 1 and 2 in assembly with a riser and showing the deflated or collapsed relation thereof in relation to a spar deck opening, such as for installation or retrieval;

FIG. 4 is a sectional view similar to that of FIG. 3 showing the fully inflated condition of the buoyancy module;

FIG. 5 is a sectional view of a two compartment buoyancy module being shown in assembly with a riser;

FIG. 6 is a sectional view similar to that of FIG. 4 and showing loose assembly of the buoyancy module to the riser to enable the buoyancy module to be lowered to desired depth and then secured to the riser;

FIG. 7 is an elevational view showing a plurality of buoyancy modules in assembly with a riser and also showing an inflation, deflation and ballast manifold in connection therewith;

FIG. 8 is an elevational view of the upper section of a subsea well riser assembly extending from the sea bed to a wellhead located at or above the sea surface and having a plurality of buoyancy controlling modules in assembly therewith for application of buoyancy force to selected sections of the riser assembly;

FIG. 9 is an elevational view of the lower section of the riser assembly of FIG. 8;

Figures 8, 9:
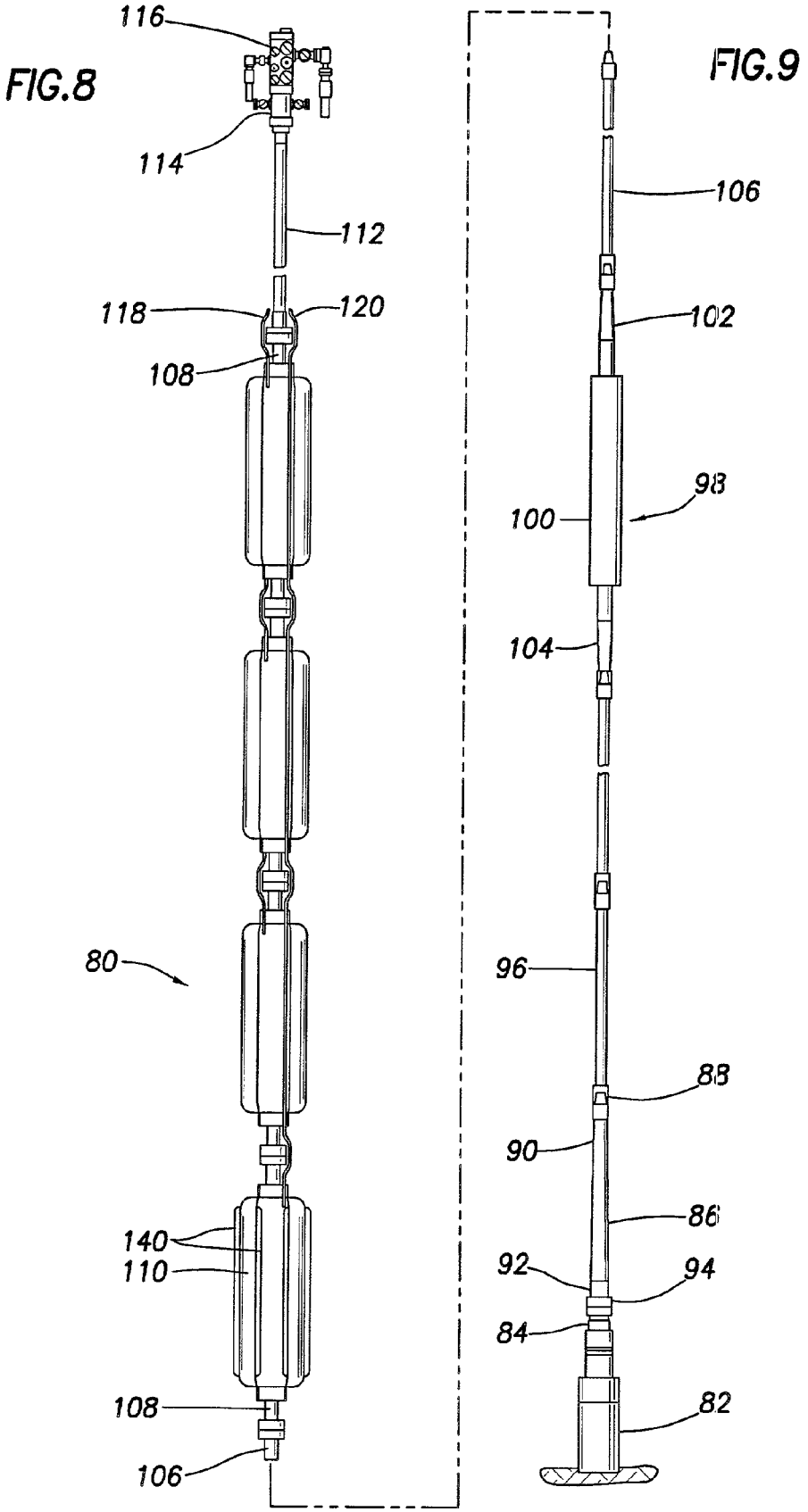
Figure 10:
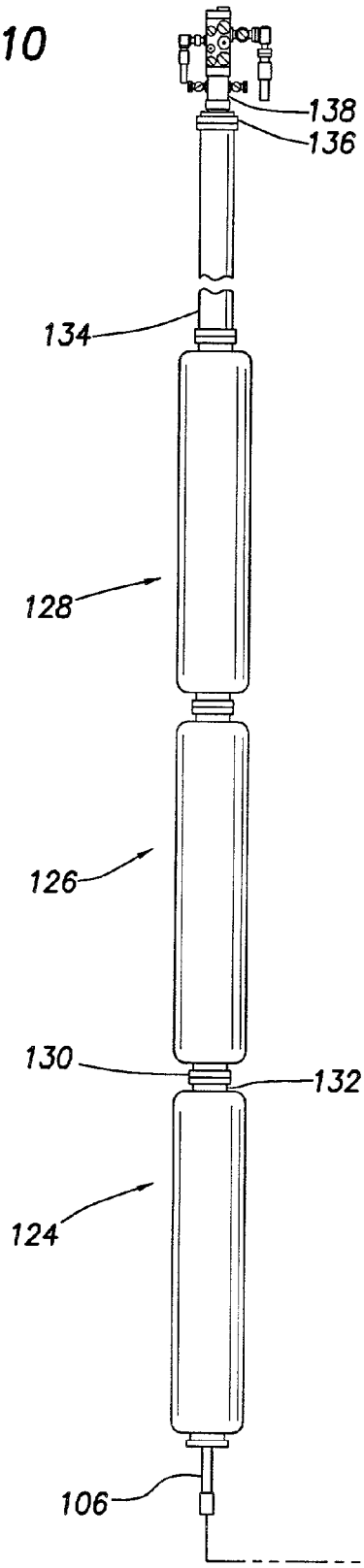
Figure 11:
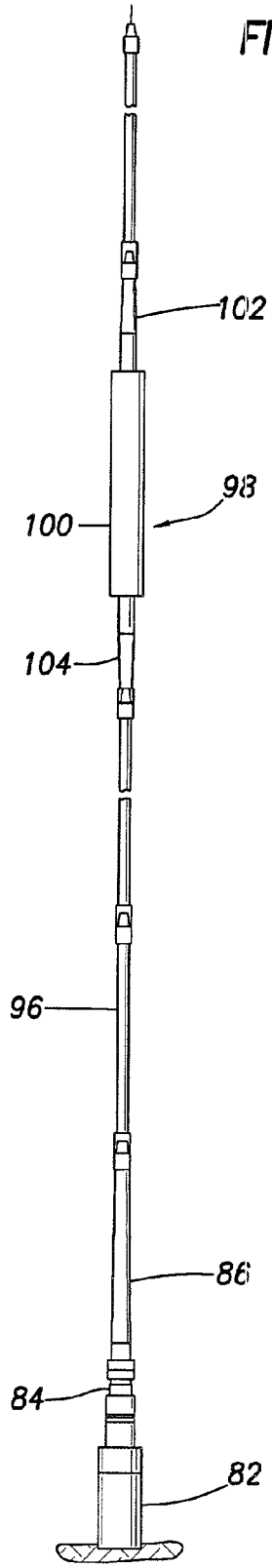

FIG. 10 is an elevational view similar to that of FIG. 8 and showing a riser assembly having buoyancy force application to the uppermost stem section of the riser assembly by a plurality of buoyancy modules being connected with one another and further showing a riser load measurement system for measuring the buoyancy force being applied to the riser assembly; and FIG. 11 is an elevational view of the lower section of the riser assembly of FIG. 10.

DETAILED DESCRIPTION OF PREFERRED EMBODIMENT

Figure 1:
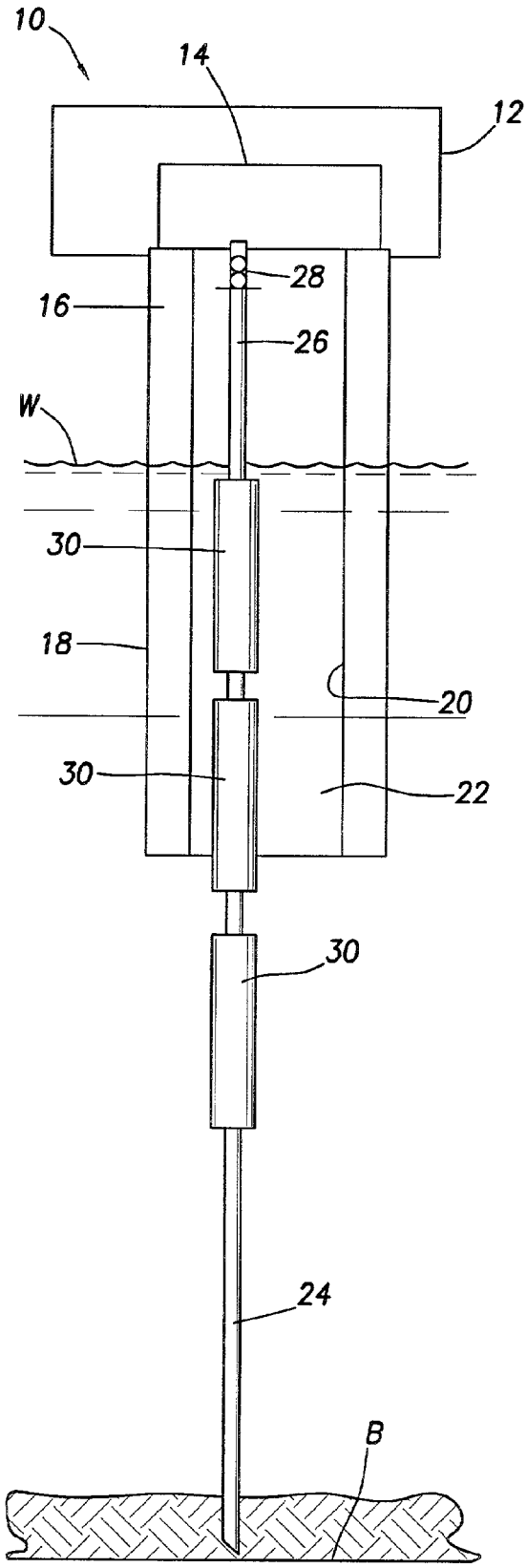

Referring now to the drawings and first to FIG. 1, a deepwater exploration spar is shown generally at 10 having a superstructure 12 defining a working deck 14. The superstructure is mounted to a buoyant spar structure 16 having a part thereof located above a water-line W of the body of water and a part thereof located below the water-line and providing buoyancy for the spar. The buoyant spar structure 16 defines an outer wall 18 and an internal wall 20 which are spaced and define buoyancy and ballast chambers for buoyancy and floatation control for the spar. The internal wall 20 of the buoyant spar structure defines an internal chamber 22 through which drilling operations may be conducted, when the spar has well drilling capability, and through which risers extend when the spar has production capability.

As shown in FIG. 1, a riser assembly 24 extends from the sea bottom B upwardly through the central internal chamber 22 of the spar, with its upper end 26 appropriately secured to production equipment such as a surface wellhead on or in the working deck 14 by means of an articulated sealed connection 28 which permits movement of the spar relative to the riser while maintaining a sealed connection of the riser with the production equipment.

To counteract the weight of the riser 24 and to minimize its application of force to the spar structure, and representing the preferred embodiment of the present invention, a plurality of buoyancy modules 30 are assembled to individual conduit sections of the riser to add upwardly directed buoyancy forces at suitable locations along the length of the riser assembly. One of the buoyancy modules 30 is shown in greater detail in FIG. 2. According to the preferred embodiment of the present invention, the buoyancy module 30 incorporates a centrally located longitudinal tubular member 32 having upper and lower extremities which define riser joint connectors 34 and 36 and which also define buoyancy module travel stops 38 and 40. The buoyancy module travel stops 38 and 40 are disposed for force transmitting engagement with corresponding force transmitting collars or other force transmitting and travel stop structures 42 and 44 of the riser assembly 24 so that upwardly directed buoyancy forces or downwardly directed weight forces of the buoyancy module, as the case may be, will be transmitted to the riser assembly.

To the centrally located longitudinal tubular member 32, representing a riser section, is fixed an expandable and contractible pressure tight envelope 46 composed of rubber or rubber-like material and which may be reinforced by appropriate layers of fabric or scrim embedded within the material. The envelope 46 is secured to the longitudinal tubular member 32 in any suitable fashion, such as by means of upper and lower clamps 48 and 50 which are received about upper and lower clamp flanges 52 and 54 of the envelope structure. Alternatively, the envelope structure may define an inner sleeve structure which may be built up on the longitudinal tubular member 32 and may be bonded or cemented to the longitudinal tubular member during manufacture of the buoyancy module. To provide the expandable and contractable envelope with wear resistance, to protect it during its passage through small openings of the spar, a plurality of metal or non-metal wear strips may be fixed to the external surface of the envelope. These wear strips are arranged so that the collapsing and expanding character of the envelope will not be diminished.

Figure 2:
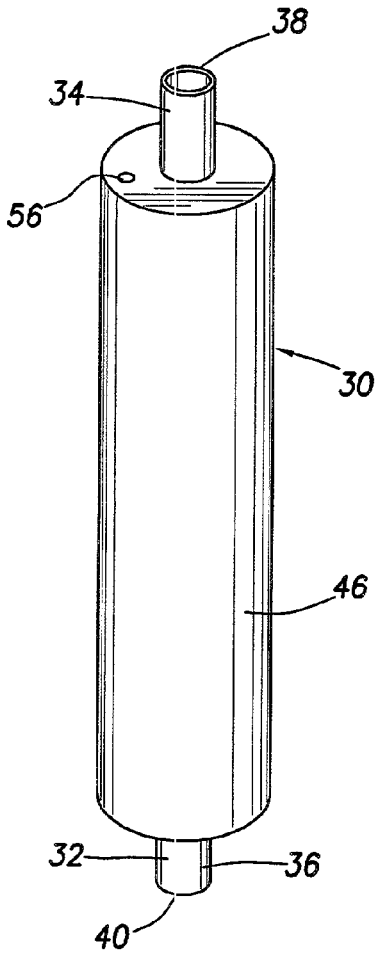
Figure 3:
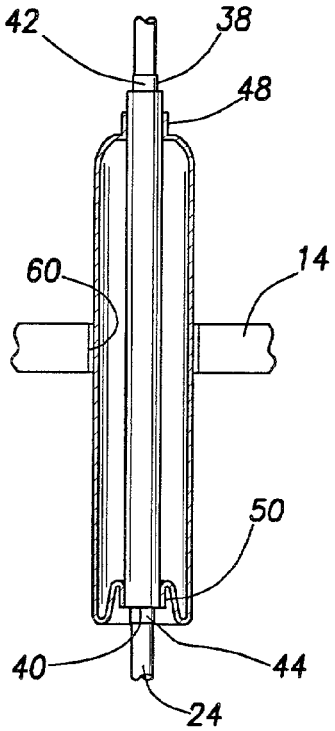

As is evident from FIG. 2, the collapsible and expandable envelope member 30 is provided with an access port 56, such as in an upper wall 57 thereof, through which a buoyant medium such as air or other gas or a polymer foam is introduced and a ballast medium such as water or a polymer into one or more internal chambers 58 of the envelope and through which water or other ballast is introduced into or withdrawn from the internal chamber 58 as desired for buoyancy control and for controlled buoyancy force stabilization. The envelope 46 is capable of expansion and contraction for controlled buoyancy force application and to enable the buoyancy module to be passed through a relatively narrow opening of the spar structure, such as a rotary table opening 60 of the working deck 14 of the spar 10, as shown in FIG. 3. This feature enables installation of the buoyancy modules through utilization of the lift equipment that it typically present on most drilling and production vessels. It will not be necessary to employ heavy lift vessel/derrick barges for installation of buoyant riser weight support as is typically done at the present time. During installation of the buoyancy module during riser tieback, the buoyancy module can be assembled to the riser at the working deck lever of the spar. To enable the expandable and contractible envelope 46 to pass through the working deck opening or rotary table opening 46, the envelope 46 is at its collapsed condition so that it defines a minimum diameter. If desired, suction can be applied at the access port to ensure complete collapse of the envelope. The buoyancy module is lowered through the opening 46 along with the riser and, after passage through the opening, either above the water-line or below the water-line the envelope will be inflated by introducing air or any other gas into the envelope to a desired inflation pressure. This will expand the flexible envelope to its desired diameter for buoyancy force transmission to the riser.

If desired, the buoyancy module may be caused to remain deflated until tieback of the riser has been completed. In such case, inflation and ballast lines can be connected with the access port 56 so that inflation and deflation of the flexible envelope can be accomplished by appropriate control of gas and ballast equipment located on the spar. In the alternative, the buoyancy modules may be provided with appropriate fittings through which air or other gas or liquid is passed as desired for inflation, deflation and ballast control. These fittings can be accessible by remote operating vehicle (ROV) to permit remotely controlled addition or removal of gas or ballast and to control the effective diameter of the buoyancy modules to facilitate retrieval thereof. Of course, deflation of the flexible envelope of a submerged buoyancy module is enhanced by the hydrostatic pressure of the sea water that exists at the water depth location thereof. In the event subsequent deflation of some or all of the buoyancy modules is not desired, the flexible envelopes of selected buoyancy modules may be inflated with an uncured, essentially liquid polymer foam material which subsequently cures to define permanently inflated buoyancy modules. These modules are preferably designed for releasable attachment to selected sections of the riser assembly or are interconnected to apply buoyancy force to the upper extremity of the riser assembly.

Figure 7:
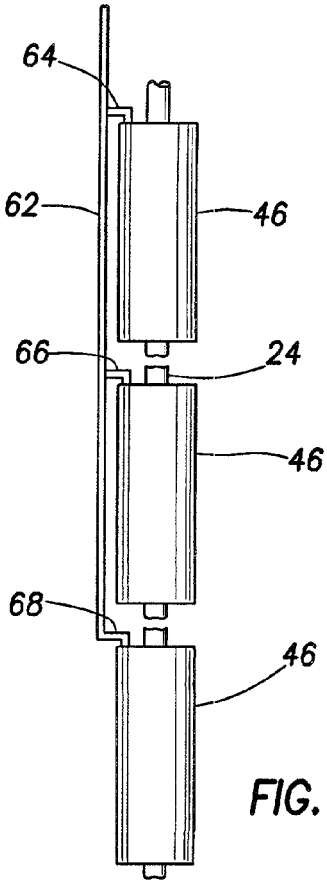

Referring to FIG. 7, for riser weight support and buoyancy control, a plurality of buoyancy modules may be assembled in series along the length of the riser. For inflation control, a manifold line 62 may be extended from the spar to the depth of the buoyancy modules and may be connected with the respective access ports 56 of each of the envelopes 46. The buoyancy modules may be inflated simultaneously by application of gas pressure. More practically, since the buoyancy modules will be located at differing water depths, the manifold line 62 may include valves which permit selective envelope inflation to accommodate the hydrostatic pressure existing at the particular water depth of individual envelopes. Also, if desired, each of the inflation modules may be provided with an independent inflation and ballast line for individual inflation and ballast control. Additionally, for ballast control, each of the buoyancy modules may be provided with an internal ballast line so that ballast interchange can be accomplished when the buoyancy module is located at desired water depth. Separate gas interchange and ballast interchange lines may be connected with the internal chambers of the flexible envelopes if desired.

Figure 5:
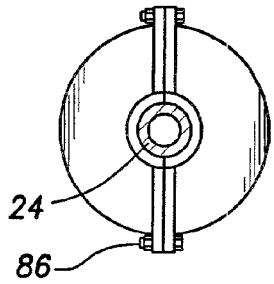
Figure 6:
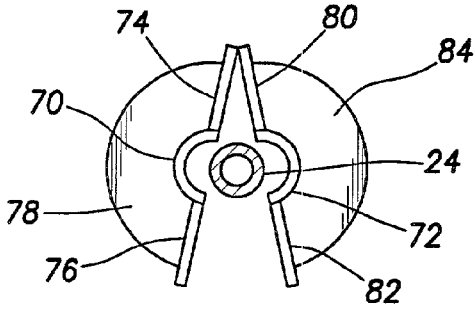
Figure 4:
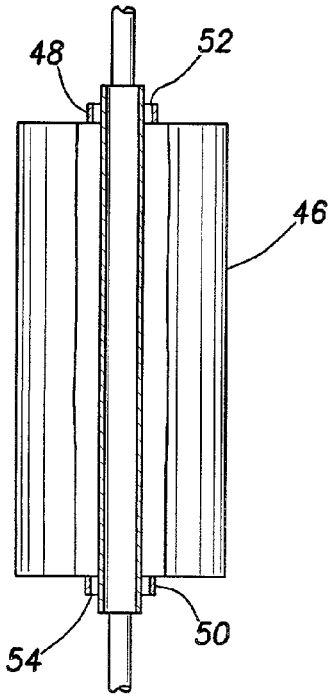

Installation of riser weight control may also be accomplished after riser tieback if desired. In such case, the buoyancy modules can be in for form of two or more buoyancy sections as shown in FIGS. 5 and 6. The plan view in section of FIG. 5 illustrates a buoyancy module having two generally semi-cylindrical sections which are adapted to be clamped to a riser 24. A longitudinal tubular element, being the equivalent of the longitudinal tubular element 32 of FIG. 2, is shown to be defined by a pair of semi-cylindrical tube halves 70 and 72. A pair of connection flanges 74 and 76 are fixed, such as by welding, to respective sides of the of semi-cylindrical tube half 70 and project beyond the outer periphery of a flexible envelope section 78. Likewise, a pair of connection flanges 80 and 82 are fixed to opposite sides of the semi-cylindrical tube half 72 and project beyond the outer periphery of a generally semi-cylindrical envelope section 84. Each of the envelope sections 78 and 84 will be provided with an independent access port for gas introduction and removal, which access ports may be connected with a common manifold line for inflation and deflation control of the envelope sections. As shown in FIG. 5, bolts, clamps or other suitable connector devices 86 may be used to clamp the module sections to the riser 24. During installation of the buoyancy module, the sections thereof may be loosely assembled about the riser 24, thus permitting the buoyancy module to be lowered to desired water depth, using the riser as a guide. When the buoyancy module has reached its desired water depth, the connector devices can be tightened to secure the module sections to the riser. A remote operating vehicle (ROV) may be employed for this purpose.

Referring now to FIGS. 8 and 9, a ballasted and buoyancy controller riser assembly is shown generally at 80, with FIG.

8 showing the upper section of the riser assembly and FIG. 9 showing a lower section of the riser assembly. A subsea wellhead system is shown at 82 having an internal tieback connector 84 establishing communication with production flow passages or conduits of the wellhead system. Above the wellhead and tieback connector is connected a tapered stress joint 86 which tapers from a minimum diameter 90 at a riser connection joint downwardly to a maximum diameter 92 at a tieback connector joint 94. Thus, the tapered stress joint of conduit of the riser assembly is more rigid at its lower extremity and more flexible at its upper extremity, so that stresses on the riser assembly are readily accommodated by the tapered stress joint. A number of joints 96 of riser conduit extend upwardly from the tapered stress joint 86 to a keel joint assembly, shown generally at 98, which provides for ballast control and stabilization of the riser assembly. The keel joint assembly 98 incorporates an intermediate, large diameter section 100 of conduit and upper and lower keel conduit sections 102 and 104 which are of greater diameter as compared with the diameter of the various sections of riser joint conduit material 96. Other interconnected riser joint conduit sections 106 make up the riser assembly up to the upper, buoyant section of the riser assembly 80. A plurality of buoyant riser sections 108 are provided, each having an inflatable riser can 110. The uppermost one of the buoyant riser sections 108 is connected to a stem joint 112, which is in turn connected to a surface wellhead assembly 114, such as is typically supported by the superstructure of a deepwater development structure such as a production or drilling and production spar. A surface Christmas tree is mounted to the surface wellhead assembly for controlling the production flow of the subsea well and also enabling various subsea well servicing and testing procedures to be carried out.

For buoyancy control, the inflatable riser buoyancy cans are provided with buoyancy and ballast control conduits 118 and 120 which permit a gaseous medium such as air to be controllably introduced into or bled from the inflatable cans for controlling application of buoyancy force to the riser assembly. The buoyancy force of the inflatable buoyant cans may be applied by the interconnected system or string of buoyant riser cans to the riser stem 112 at or near the water surface or in the alternative may be applied by the riser cans to individual riser sections of the riser assembly. The ballast control conduits 120 permit each or selected ones of the inflatable riser cans to be ballasted, such as by adding or removing a ballast fluid such as water to thus control the buoyancy of each of the inflatable riser cans according to the buoyancy force and buoyancy force location that is needed for the riser assembly. In cases where permanently inflated buoyancy force riser weight offsetting units are desired, the flexible buoyancy control elements may be passed through the small rotary drilling table opening or small deck openings of the deepwater production spar in the collapsed condition thereof. When buoyancy force application is desired an uncured, essentially liquid polymer foam composition may be used to inflate all or part of the flexible envelopes. The polymer foam composition will then become cured within the envelopes, thereby defining permanently expanded or inflated buoyancy control devices. These buoyancy control devices will be quite durable and resistant to damage. They can also be releasably assembled to the riser and thus removable if desired.

The lower riser section shown in FIG. 11 is of the same general construction and function as described above in connection with FIG. 9; thus like reference numerals are used to indicate like parts. In FIG. 10 a plurality of buoyancy and ballast controlled riser sections are shown generally at 124, 126 and 128. In this case the individual buoyant and ballasted sections are joined by assembly flanges such as shown at 130. The connected joints of riser conduit 106 extend upwardly through the larger conduit sections 132 of the buoyancy can assemblies to a stem conduit 134, so that the combined force of the riser cans is directed through a riser load measurement system 136 to the surface wellhead 138, thus placing the production conduit riser assembly in tension. The tension force being applied to the production conduit riser assembly by the buoyancy and ballast control system is controlled by selective individual inflation and ballast control of the inflatable buoyancy cans. Since each of the buoyancy cans is individually controlled from the standpoint of buoyancy and ballast, the riser system may be efficiently controlled to suit the needs of the deepwater development spar or other offshore drilling and production system with which the buoyancy control system is provided.

Since the buoyancy cans are intended to be passed through rather small openings, such as the opening of a rotary table of a well drilling system or small diameter deck openings of a deepwater development spar, it is envisioned that the flexible material from which the collapsible buoyancy cans are composed may be subject to snagging or rubbing on the deck opening of the spar and thus may be subject to damage during installation. To overcome this potential problem, the flexible material of the buoyancy cans may be lined with strips 140 of wear resistant and snag resistant material as shown in FIG. 8. These wear resistant strips may be composed of any suitable metal or non-metal material and are positioned so as not to interfere with expansion and contraction of the flexible buoyancy cans for buoyancy and ballast control.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for adding upward force to a marine riser supported by a marine structure for counteracting the weight the marine riser in the marine environment, comprising:

(a) attaching at least one inflatable buoyancy module to a marine riser, said inflatable buoyancy module defining at least one internal inflation chamber and having a deflated condition and an inflated condition developing an upwardly directed buoyancy force;

(b) inflating said inflatable buoyancy module to apply an upwardly directed buoyancy force to said marine riser to reduce the effective weight of the marine riser; and (c) inflating said inflatable buoyancy module with an uncured essentially liquid polymer foam material which subsequently cures to a substantially solid condition.

2. A method for adding upward force to a marine riser supported by a marine structure for counteracting the weight the marine riser in the marine environment, comprising:

(a) attaching at least one inflatable buoyancy module to a marine riser, said inflatable buoyancy module defining at least one internal inflation chamber and having a deflated condition and a distended inflated condition developing an upwardly directed buoyancy force;

(b) inflating said inflatable buoyancy module with a buoyant medium to apply an upwardly directed buoyancy force to said marine riser to reduce the effective weight of the marine riser; and introducing a liquid composition into said inflatable buoyancy module for ballast.

3. A method for adding upward force to a marine riser supported by a marine structure for counteracting the weight of the marine riser in the marine environment, wherein the marine structure defines an opening having a defined dimension, said method comprising:

(a) attaching at least one inflatable buoyancy module to the marine riser, said inflatable buoyancy module being of greater external dimension when at said inflated condition as compared to the external dimension thereof at said collapsed condition and defining at least one internal inflation chamber and having a deflated condition and an inflated condition and when at said inflated condition in the marine environment developing an upwardly directed buoyancy force;

(b) with said inflatable buoyancy module at said deflated condition, moving the marine riser and said inflatable buoyancy module through the marine structure opening; and (c) after moving the marine riser and said inflatable buoyancy module through the marine structure opening, inflating said inflatable buoyancy module to a dimension greater than the defined dimension of the marine structure opening and when submerged in the marine environment causing said inflatable buoyancy module to apply an upwardly directed force to said marine riser to reduce the effective weight of the marine riser.

4. The method of claim 3, wherein said inflatable buoyancy module is defined by at least two buoyancy module sections, each defining an internal buoyancy chamber, said method comprising:

(a) assembling said buoyancy module sections to the marine riser; and (b) introducing an inflation medium into each of said internal buoyancy chambers for inflating each of said buoyancy module sections.

5. The method of claim 3, wherein each of the buoyancy modules is capable of controlled expansion from a minimum dimension at said deflated condition to a maximum dimension when completely inflated and an inflation gas supply being located on said marine structure and connected by an inflation control system with said internal inflation chambers, said method comprising:

selectively and controllably actuating said inflation control system and introducing inflation gas from said inflation gas supply into said inflation chambers and inflating each of said inflatable buoyancy modules to the desired extent.

6. A method for adding upward force to a marine riser supported by a marine structure for counteracting the weight of the marine riser in the marine environment, comprising:

(a) assembling a plurality of inflatable buoyancy modules to the marine riser in serially oriented fashion and at selective locations along the length of the marine riser, each of said inflatable buoyancy modules having at least one internal inflation chamber having a deflated condition and having a distended inflated condition developing an upwardly directed buoyancy force; and (b) selectively inflating said internal inflation chambers of said inflatable buoyancy modules for applying selective buoyancy force thereof at selective locations along the length of the marine riser and collectively reducing the effective weight of the marine riser.

7. A method for adding upward force to a marine riser supported by a marine structure for counteracting the weight of the marine riser in the marine environment, comprising:

(a) assembling a plurality of inflatable buoyancy modules to the marine riser in serially oriented fashion, each of said inflatable buoyancy module defining at least one internal inflation chamber and having a deflated condition and having a distended inflated condition developing an upwardly directed buoyancy force when submerged in water; and (b) selectively inflating each of said inflatable buoyancy modules for applying the buoyancy force to the upper end of the marine riser.

8. A method for adding upward force to a marine riser supported by a marine structure for counteracting the weight of the marine riser in the marine environment, wherein said plurality of inflatable buoyancy modules have an inflation control system interconnected therewith, said method comprising:

(a) attaching at least one inflatable buoyancy module to a marine riser, said inflatable buoyancy module defining at least one internal inflation chamber and having a deflated condition and a distended inflated condition developing an upwardly directed buoyancy force;

(b) inflating said inflatable buoyancy module with a buoyant medium to apply an upwardly directed buoyancy force to said marine riser to reduce the effective weight of the marine riser; and (c) actuating said inflation control system for selectively inflating each of said plurality of inflatable buoyancy modules.

9. In a marine structure having a riser support and having at least one marine well production riser extending from said riser support downwardly to a subsurface riser well connection, the improvement comprising:

(a) at least one inflatable buoyancy module defining a flexible inflatable envelope and being secured to the marine well production riser and having a deflated dimension enabling its movement through small deck openings of the marine structure and an inflated condition of greater dimension as compared to the small deck openings and providing buoyancy force to the marine riser to offset the weight thereof;

(b) at least one access port being defined by said inflatable buoyancy module and having communication with said internal inflation chamber; and (c) a buoyancy control system having a source of inflation medium for communication with said at least one access port and permitting selective flow of inflation medium from said source through said access port and into said at least one inflation chamber for desired inflation of said inflatable buoyancy module.

10. The improvement of claim 9, comprising:

(a) said inflatable buoyancy module having a minimum external dimension at said deflated condition thereof and a maximum external dimension at said fully inflated condition thereof; and (b) the marine structure defining a deck opening having a defined dimension permitting passage of said inflatable buoyancy module therethrough only when said inflatable buoyancy module is at said deflated condition defining said minimum external dimension thereof.

11. The improvement of claim 9, comprising:

said inflatable buoyancy module being passed through said riser opening while attached to the riser during deployment of said inflatable buoyancy module and during recovery of said inflatable buoyancy module.

12. The improvement of claim 9, comprising:

(a) said inflatable buoyancy module having a tubular member located centrally thereof and receiving said riser therein; and (b) said tubular member defining a riser joint connector and buoyancy module travel stops at upper and lower ends of said tubular member, said buoyancy module travel stops being disposed for force transmitting engagement with riser structure for transmission of force from said inflatable buoyancy module to the riser.

13. The improvement of claim 9, comprising:

a plurality of wear resistant elements being fixed externally of said flexible inflatable envelope and resisting damage of said flexible inflatable envelope during movement thereof relative to the marine structure.

14. The improvement of claim 9, comprising:

(a) a plurality of inflatable buoyancy modules being assembled at desired locations along the length of the riser, each of said inflatable buoyancy modules defining a least one access port; and (b) said source of inflation medium being an inflation gas supply being connected with said access port of each of said inflatable buoyancy modules for introducing pressurized gas into said internal chamber for inflation thereof and for removing gas from said internal chamber for deflation thereof.

15. The improvement of claim 14, wherein:

said inflation gas supply causing independently controlled inflation of said plurality of inflatable buoyancy modules.

16. The improvement of claim 14, wherein:

said inflation gas supply causing simultaneously controlled inflation of said plurality of inflatable buoyancy modules.

17. The improvement of claim 9, wherein the marine structure defines a working opening of defined diameter, each of said inflatable buoyancy modules comprising:

(a) a longitudinal tubular element;

(b) a flexible pressure tight envelope being fixed to said longitudinal tubular element and defining at least one internal chamber, said flexible pressure tight envelope having at least one access port and being collapsible to a diameter less than the defined diameter for passage through the working opening of the spar structure and being expandable by inflation to a diameter exceeding the defined diameter of the working opening of the spar structure.

18. The improvement of claim 9, comprising:

(a) a plurality of inflatable buoyancy modules being assembled at desired locations along the length of the riser, each of said inflatable buoyancy modules defining a least one access port; and (b) said source of inflation medium being an uncured polymer inflation supply being connected with at least one of said access ports of said inflatable buoyancy modules for introducing pressurized uncured polymer into said internal chamber or at least one buoyancy module for inflation thereof, said uncured polymer subsequently curing to define at least one permanently inflated buoyancy module.

19. The improvement of claim 18, wherein:

said inflatable buoyancy modules each having at least two interfitting sections each defining an independent flexible pressure tight envelope and each being independently collapsible and expandable.

20. In a deepwater production development spar having a riser support and having at least one marine riser extending from said riser support downwardly to a subsurface riser connection, the buoyant deepwater production development spar defining a working opening having a defined diameter, the improvement comprising:

(a) at least one longitudinal tubular element defining an internal passage receiving the riser therein;

(b) at least one expandable and contractible pressure tight envelope being fixed to said longitudinal tubular element and defining at least one internal inflation chamber therein, said expandable and contractible pressure tight envelope having a deflated condition defining a diameter less than the defined diameter of the working opening permitting passage thereof through said working opening along with the riser and an inflated condition defining a diameter greater than said defined diameter of the working opening;

(c) at least one access port being defined by said expandable and contractible pressure tight envelope and having communication with said internal inflation chamber; and (d) a buoyancy control system having a source of inflation medium for communication with said at least one access port and permitting selective flow of inflation medium from said source of inflation medium through said access port and into said at least one inflation chamber for desired inflation of said expandable and contractible pressure tight envelope.

21. The improvement of claim 20, wherein the riser defines stop structure, said inflatable buoyancy modules comprising:

said longitudinal tubular element defining upper and lower module travel stops disposed for contact with the riser stop structure.

22. The improvement of claim 20, wherein:

(a) said longitudinal tubular element having envelope retention structure; and (b) said flexible expandable and contractible pressure tight envelope having retained engagement with said envelope retention structure.

23. The improvement of claim 20, comprising:

(a) a plurality of inflatable buoyancy modules being assembled at desired locations along the length of the riser, each of said inflatable buoyancy modules defining a least one access port; and (b) an inflation gas supply being connected with said access port of each of said inflatable buoyancy modules for introducing pressurized gas into said internal chamber for inflation thereof and for removing gas from said internal chamber for deflation thereof.

* * * * *

UNITED STATES PATENT AND TRADEMARK OFFICE

CERTIFICATE OF CORRECTION

PATENT NO. : 7,008,141 B2
APPLICATION NO. : 09/730414
DATED : March 7, 2006
INVENTOR(S) : John A. Fitzgerald et al.

It is certified that error appears in the above-identified patent and that said Letters Patent is hereby corrected as shown below:

At Column 2, line 15, delete the word “slops” and insert the word --“stops”--.

Signed and Sealed this

Eighteenth Day of July, 2006

JON W. DUDAS
*Director of the United States Patent and Trademark Office*